US007914304B2

(12) United States Patent
Cartier et al.

(10) Patent No.: US 7,914,304 B2
(45) Date of Patent: Mar. 29, 2011

(54) ELECTRICAL CONNECTOR WITH CONDUCTORS HAVING DIVERGING PORTIONS

(75) Inventors: Marc B. Cartier, Dover, NH (US); Brian Kirk, Amherst, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/476,831

(22) Filed: Jun. 29, 2006

(65) Prior Publication Data

US 2007/0059961 A1 Mar. 15, 2007

Related U.S. Application Data

(60) Provisional application No. 60/695,308, filed on Jun. 30, 2005, provisional application No. 60/695,264, filed on Jun. 30, 2005.

(51) Int. Cl.
*H01R 12/00* (2006.01)

(52) U.S. Cl. ..... 439/83

(58) Field of Classification Search ..... 439/676, 439/607, 608, 83, 502, 78, 82, 884, 891
See application file for complete search history.

(56) References Cited

U.S. PATENT DOCUMENTS 4,472,765 A 9/1984 Hughes
4,655,518 A 4/1987 Johnson et al.
4,674,812 A 6/1987 Thom et al.
4,686,607 A 8/1987 Johnson
4,876,630 A 10/1989 Dara
4,902,243 A * 2/1990 Davis ..... 439/405
5,259,773 A 11/1993 Champion et al.
5,335,146 A 8/1994 Stucke
5,352,123 A 10/1994 Sample et al.
5,429,520 A 7/1995 Morlion et al.
5,429,521 A 7/1995 Morlion et al.
5,795,191 A * 8/1998 Preputnick et al. ..... 439/608
5,870,528 A 2/1999 Fukuda
5,887,158 A 3/1999 Sample et al.
5,931,686 A 8/1999 Sasaki et al.
5,971,809 A * 10/1999 Ho ..... 439/660
6,163,464 A 12/2000 Ishibashi et al.
6,299,483 B1 * 10/2001 Cohen et al. ..... 439/608
6,299,492 B1 * 10/2001 Pierini et al. ..... 439/884
6,328,572 B1 12/2001 Higashida et al.
6,379,188 B1 4/2002 Cohen et al.
6,392,142 B1 5/2002 Uzuka et al.
6,409,543 B1 6/2002 Astbury et al.
6,435,913 B1 8/2002 Billman
6,454,605 B1 * 9/2002 Bassler et al. ..... 439/609
6,461,202 B2 10/2002 Kline
6,503,103 B1 1/2003 Cohen et al.
6,506,076 B2 1/2003 Cohen et al.
6,517,360 B1 2/2003 Cohen
6,527,587 B1 3/2003 Ortega et al.
6,528,737 B1 3/2003 Kwong et al.
(Continued)

*Primary Examiner* — Chandrika Prasad
(74) *Attorney, Agent, or Firm* — Blank Rome LLP

(57) ABSTRACT

An electrical connector that includes a dielectric housing and at least one pair of signal conductors adapted to mate with a printed circuit board. The pair of signal conductors include first and second conductors. The first conductor includes a first mating portion, a first contact portion remote from the first mating portion, and a the intermediate portion therebetween. The second conductor includes a second mating portion, a second contact portion remote from the second mating portion, and a second intermediate portion therebetween. Each of the first and second mating portions define a mating portion axis and each of the first and second contact portions define a contact portion axis. The contact portion axes are offset from the mating portion axis.

17 Claims, 7 Drawing Sheets

U.S. PATENT DOCUMENTS 6,538,899 B1 3/2003 Krishnamurthi et al.
6,540,522 B2 4/2003 Sipe
6,541,712 B1 4/2003 Gately et al.
6,554,647 B1 * 4/2003 Cohen et al. ..... 439/607
6,602,095 B2 * 8/2003 Astbury et al. ..... 439/608
6,608,762 B2 8/2003 Patriche
6,663,427 B1 12/2003 Billman et al.
6,663,429 B1 12/2003 Korsunsky et al.
6,705,895 B2 3/2004 Hasircoglu
6,717,825 B2 4/2004 Volstorf
6,743,057 B2 6/2004 Davis et al.
6,764,341 B2 7/2004 Lappoehn
6,776,659 B1 8/2004 Stokoe et al.
6,786,771 B2 * 9/2004 Gailus ..... 439/607.01
6,808,419 B1 * 10/2004 Korsunsky et al. ..... 439/607
6,808,420 B2 10/2004 Whiteman et al.
6,816,486 B1 11/2004 Rogers
6,817,870 B1 11/2004 Kwong et al.
6,872,085 B1 3/2005 Cohen et al.
6,899,566 B2 5/2005 Kline et al.
6,903,939 B1 6/2005 Chea et al.
6,913,490 B2 7/2005 Whiteman et al.
6,957,967 B2 * 10/2005 Petersen et al. ..... 439/78
6,960,103 B2 11/2005 Tokunaga
6,971,916 B2 12/2005 Tokunaga
7,094,102 B2 8/2006 Cohen et al.
7,270,573 B2 * 9/2007 Houtz ..... 439/608
7,303,427 B2 * 12/2007 Swain ..... 439/487
7,309,239 B2 * 12/2007 Shuey et al. ..... 439/74
7,322,855 B2 1/2008 Mongold et al.
7,371,117 B2 * 5/2008 Gailus ..... 439/607.08
2001/0046810 A1 11/2001 Cohen et al.
2002/0086582 A1 7/2002 Nitta et al.
2002/0111068 A1 8/2002 Cohen et al.
2002/0111069 A1 8/2002 Astbury et al.
2002/0123266 A1 9/2002 Ramey et al.
2002/0168898 A1 11/2002 Billman et al.
2002/0181215 A1 12/2002 Guenthner
2003/0003803 A1 1/2003 Billman et al.
2003/0008561 A1 1/2003 Lappoehn
2003/0022555 A1 1/2003 Vicich et al.
2003/0143894 A1 7/2003 Kline et al.
2003/0220021 A1 11/2003 Whiteman et al.
2004/0043661 A1 3/2004 Okada et al.
2004/0115968 A1 6/2004 Cohen
2004/0224559 A1 11/2004 Nelson et al.
2004/0259419 A1 12/2004 Payne et al.
2005/0020135 A1 1/2005 Whiteman et al.
2005/0070160 A1 3/2005 Cohen et al.
2005/0148239 A1 7/2005 Hull et al.
2005/0215121 A1 9/2005 Tokunaga
2006/0019538 A1 1/2006 Davis et al.
2006/0024983 A1 2/2006 Cohen et al.
2006/0024984 A1 2/2006 Cohen et al.
2006/0073709 A1 4/2006 Reid
2007/0054554 A1 * 3/2007 Do et al. ..... 439/608
2007/0141872 A1 * 6/2007 Szczesny et al. ..... 439/108

* cited by examiner

ELECTRICAL CONNECTOR WITH CONDUCTORS HAVING DIVERGING PORTIONS

RELATED APPLICATIONS

This application claims benefit under 35 U.S.C. §119 of U.S. Provisional Patent Application Ser. No. 60/695,308 filed Jun. 30, 2005. This application may relate to commonly owned, co-pending U.S. application Ser. No. 11/476,758, U.S. Patent Application Pub. No. 2007/0042639, entitled Connector With Improved Shielding In Mating Contact Region, filed on Jun. 29, 2006, based on U.S. Provisional Application No. 60/695,264, the subject matter of which is herein incorporated be reference.

FIELD OF INVENTION

This invention relates generally to electrical connectors for interconnection systems, such as high speed electrical connectors, with improved signal integrity.

BACKGROUND OF THE INVENTION

Electrical connectors are used in many electronic systems. Electrical connectors are often used to make connections between printed circuit boards ("PCBs") that allow separate PCBs to be easily assembled or removed from an electronic system. Assembling an electronic system on several PCBs that are then connected to one another by electrical connectors is generally easier and more cost effective than manufacturing the entire system on a single PCB.

Electronic systems have generally become smaller, faster and functionally more complex. These changes mean that the number of circuits in a given area of an electronic system, along with the frequencies at which those circuits operate, have increased significantly in recent years. Current systems pass more data between PCBs than systems of even a few years ago, requiring electrical connectors that are more dense and operate at higher frequencies.

As connectors become more dense and signal frequencies increase, there is a greater possibility of electrical noise being generated in the connector as a result of reflections caused by impedance mismatch or cross-talk between signal conductors. Therefore, electrical connectors are designed to control cross-talk between different signal paths and to control the impedance of each signal path. Shield members, which are typically metal strips or a metal plate connected to ground, can influence both crosstalk and impedance when placed adjacent the signal conductors. Shield members with an appropriate design can significantly improve the performance of a connector.

High frequency performance is sometimes improved through the use of differential signals. Differential signals are signals represented by a pair of conducting paths, called a "differential pair." The voltage difference between the conductive paths represents the signal. In general, the two conducting paths of a differential pair are arranged to run near each other. In differential connectors, it is also known to position a pair of signal conductors that carry a differential signal closer together than either of the signal conductors in the pair is to other signal conductors.

Despite recent improvements in high frequency performance of electrical connectors provided by shielding, it would be desirable to have an interconnection system with even further improved performance.

SUMMARY OF INVENTION

The present invention relates to an electrical connector that includes a dielectric housing and at least one pair of signal conductors adapted to mate with a printed circuit board. The pair of signal conductors includes first and second conductors. The first conductor includes a first mating portion, a first contact portion remote from the first mating portion, and an intermediate portion therebetween. The second conductor includes a second mating portion, a second contact portion remote from the second mating portion, and a second intermediate portion therebetween. Each of the first and second mating portions defines a mating portion axis and each of the first and second contact portions define a contact portion axis. The contact portion axes are offset from the mating portion axis.

The present invention also relates to an electrical connector that includes a dielectric housing and at least one pair of signal conductors adapted to mate with a printed circuit board. The pair of signal conductors include first and second conductors. The first conductor includes a first mating portion, a first contact portion, and a first intermediate portion therebetween. The second conductor includes a second mating portion, a second contact portion, and a second intermediate portion therebetween. Each of the first and second mating portions includes a central axis, and each of the first and second contact portions defining a central axis. The central axes of the first and second mating portions define a first distance therebetween that is larger than a second distance defined between the central axes of the first and second contact portions.

The present invention also relates to an interconnection assembly that includes a first electrical connector mountable to a first printed circuit board. The first electrical connector includes a plurality of signal conductor pairs. Each of the pairs of signal conductors include first and second conductors engageable with respective pairs of first and second plated holes in the first electrical connector. The pairs of first and second plated holes being disposed in a plurality of transverse columns and rows. The first plated holes are aligned with one another to define a first axis. Each of the second plated holes is offset from a respective first plated hole such that a second axis defined between one of the first plated holes and one of the second plated holes is angularly oriented with respect to the first axis.

Objects, advantages and salient features of the invention will become apparent from the following detailed description, which, taken in conjunction with the annexed drawings, discloses a preferred embodiment of the present invention

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
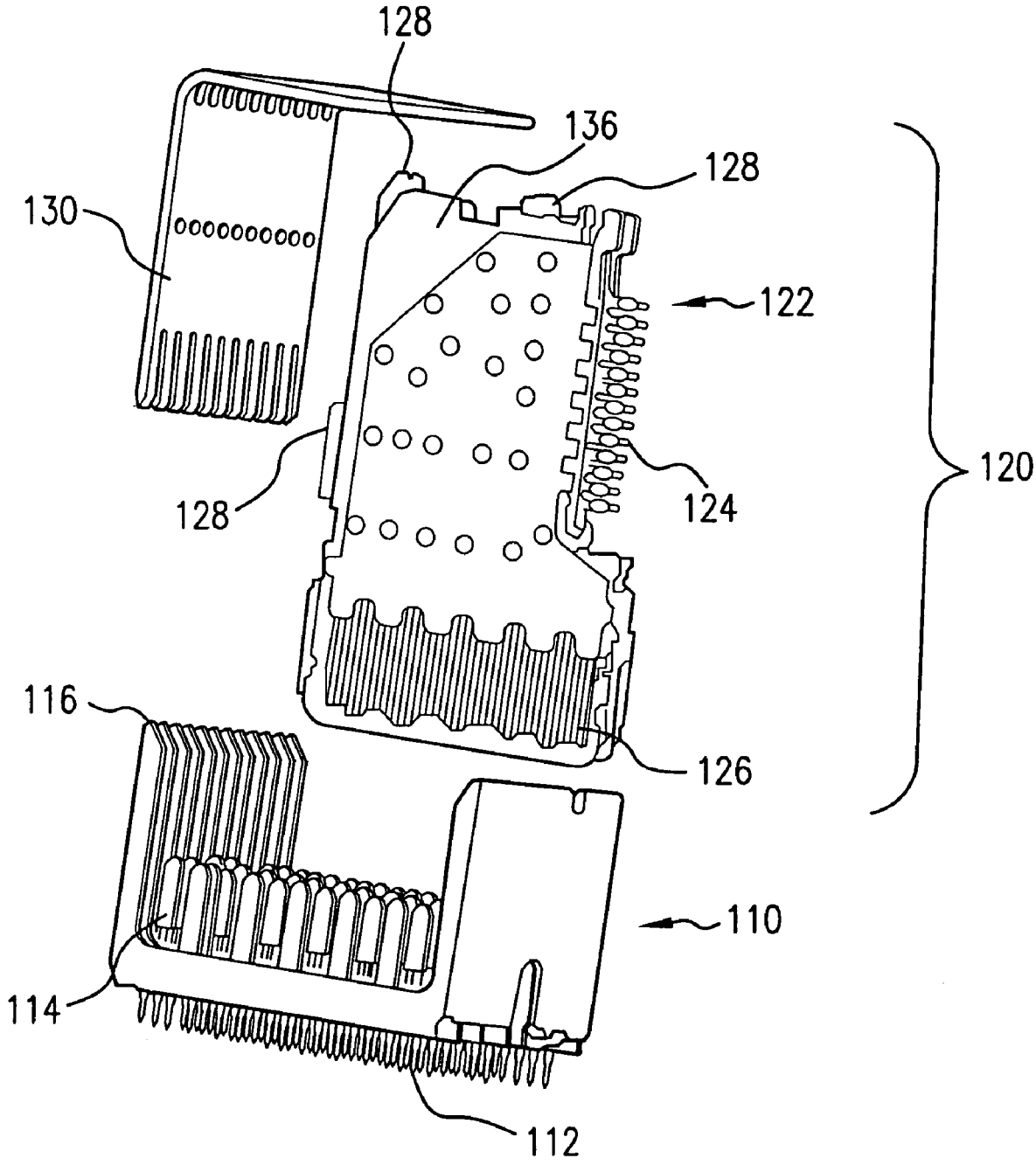
FIG. 1 (PRIOR ART)
FIG. 1 is an exploded perspective view of a prior art connector.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

FIG. 1 shows an exemplary prior art connector system that may be improved with a shielding system according to the invention. In the example of FIG. 1, the electrical connector is a two-piece electrical connector adapted for connecting printed circuit boards to a backplane at right angles. The connector includes a backplane connector 110 and a daughter card connector 120 adapted to mate to the backplane connector 110.

Backplane connector 110 includes multiple signal conductors generally arranged in columns. The signal conductors are held in housing 116, which is typically molded of plastic or other insulative material. Each of the signal conductors includes a contact tail 112 and a mating portion 114. In use, the contact tails 112 are attached to conducting traces within a backplane. In particular, contact tails 112 are press-fit contact tails that are inserted into holes in the backplane. The press-fit contact tails make an electrical connection with conductive plating inside the holes that is in turn connected to a trace within the backplane.

In the example of FIG. 1, the mating portions 114 of the signal conductors are shaped as blades. The mating portions 114 of the signal conductors in the backplane connector 110 are positioned to mate with mating portions of signal conductors in daughter card connector 120. In this example, mating portions 114 of backplane connector 110 mate with mating portions 126 of daughter card connector 120, creating a separable mating interface through which signals may be transmitted.

The signal conductors within daughter card connector 120 are held within a housing 136, which may be formed of plastic or other similar insulating material. Contact tails 124 extend from the housing of connector 120 and are positioned for attachment to a daughter card. In the example of FIG. 1, contact tails 124 of daughter card connector 120 are press-fit contact tails similar to contact tails 112.

In the embodiment illustrated, daughter card connector 120 is formed from wafers 122. For simplicity, a single wafer 122 is shown in FIG. 1. Wafers 122 are formed as subassemblies that each contain signal conductors for one column of the connector. The wafers are held together in a support structure, such as a metal stiffener 130. Each wafer includes attachment features 128 in its housing that may attach the wafer 122 to stiffener 130.

When assembled into a connector, the contact tails 124 of the wafers extend generally from a face of the insulated housing of daughter card connector 120. In use this face is pressed against a surface of a daughter card (not shown), making connection between the contact tails 124 and signal traces within the daughter card. Similarly, the contact tails 112 of backplane connector 110 extend from a face of housing 116. This face is pressed against the surface of a backplane (not shown), allowing the contact tails 112 to make connection to traces within the backplane. In this way, signals may pass from a daughter card through the signal conductors in daughter card connector 120, into the signal conductors of backplane connector 110 where they may be connected to traces within a backplane.

Figure 2:
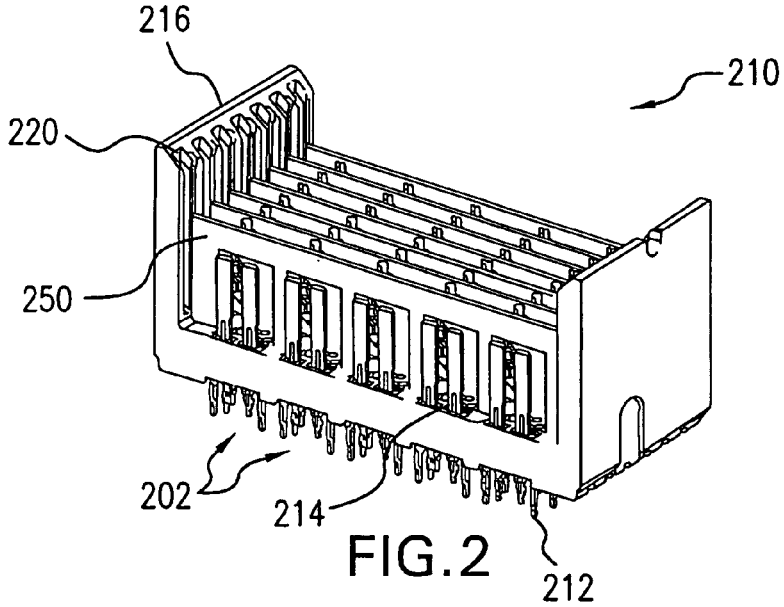
FIG. 2 is a perspective view of an electrical connector according to an embodiment of the invention.

FIG. 2 shows a backplane connector 210 according to an embodiment of the invention. Backplane connector 210 includes a housing 216, which may be molded of plastic or other suitable insulative material. Signal conductors 202 are embedded in housing 216, each with a mating portion 214 extending from a floor 218 of the housing 216 and a contact tail 212 extending from a lower surface of the housing 216. Contact tails 212 may be any known surface mount or pressure mount contact tails that engage a printed circuit board.

Contact tails 212 and mating portions 214 of the signal conductors 202 may be positioned in multiple parallel columns in housing 216. Signal conductors 202 are positioned in pairs within each column. Such a configuration is desirable for connectors carrying differential signals. FIG. 2 shows, for example, five pairs of signal conductors 202 in each column. In one embodiment, the pairs of signal conductors 202 are positioned such that the individual signal conductors 202 within a pair are closer together than the spacing between adjacent pairs, that is the spacing between a signal conductor in one pair and the next nearest signal conductor in an adjacent pair. The space between adjacent pairs of signal conductors may contain a contact tail for a shield member or other ground structure within the connector.

A shield 250 may be positioned between each column of signal conductors 202. Each shield 250 may be held in a slot 220 within housing 216. However, any suitable means of securing shields 250 may be used.

Each of the shields 250 is preferably made from a conductive material, such as a sheet of metal. Conducting shield structures may be formed in any suitable way, such as doping or coating non-conductive structures to make them fully or partially conductive, or by molding or shaping a binder filled with conducting particles. Shields 250 may include compliant members. The sheet of metal of each shield 250 may be a metal, such as phosphor bronze, beryllium copper or other ductile metal alloy.

Each shield 250 may be designed to be coupled to ground when backplane connector 210 is attached to a backplane. Such a connection may be made through contact tails on shield 250 similar to contact tails 212 used to connect signal conductors to the backplane. However, shield 250 may be connected directly to ground on a backplane through any suitable type of contact tail or indirectly to ground through one or more intermediate structures. Backplane connector 210 may be manufactured by molding housing 216, and thereafter, inserting signal conductors 202 and shield members 250 into housing 216.

Figure 3:
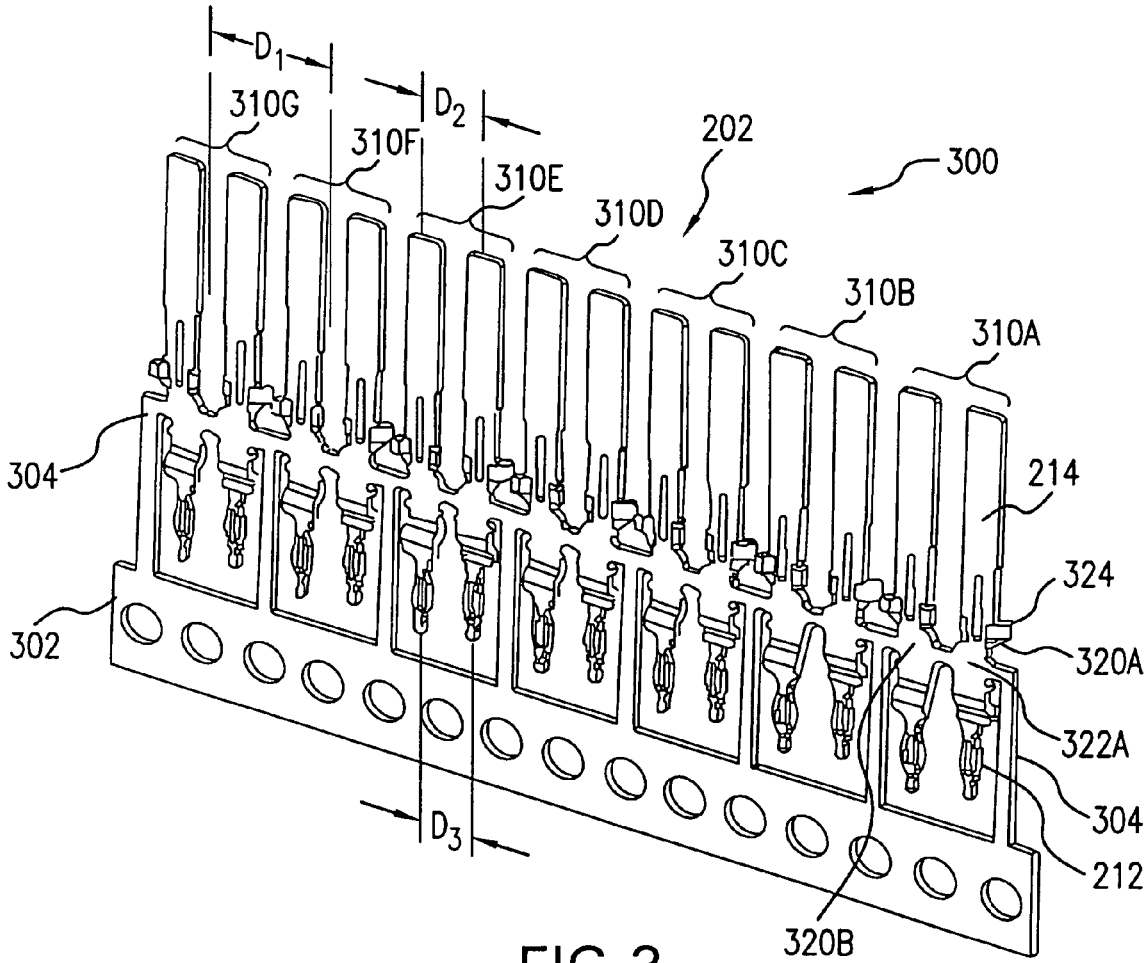
FIG. 3 is a perspective view of a leadframe used in the manufacture of the electrical connector of FIG. 2.

Turning to FIG. 3, a leadframe 300 including multiple pairs of signal conductors 202 that may be inserted into housing 216 is shown. Each pair of signal conductors 202 includes first and second signal conductors 320A and 320B. Each of the signal conductors includes a mating portion 214 and a contact tail 212. As can be seen in FIG. 3, each of the signal conductors may also include an intermediate portion 322A which may be positioned within the floor 218 of housing 216. Retention members 324 may be embedded in housing floor 218 to secure each lead frame 300 within housing 216.

Leadframe 300 may be stamped from a sheet of metal or other material used to form signal conductors 320A, 320B. Leadframe 300 may be stamped from a long strip of metal creating numerous signal conductors for simplicity. FIG. 3 shows, for example, seven pairs of signal conductors 310A, 310B, 310C, 310D, 310E, 310F, AND 310G. In embodiments in which signal conductors are stamped in a semi-continuous operation, thousands or possibly tens of thousands of signal conductors may be stamped on one strip.

The pairs of signal conductors 202 are held to carrier strip 302 with tiebars 304. Tiebars 304 are relatively thin strips of metal that may be readily severed to separate the pairs of signal conductors 202 from leadframe 300 and to subsequently insert them into connector housing 216. In some embodiments, an entire column of signal conductors may be separated from leadframe 300 in one operation and inserted in housing 216. However, any number of signal conductors may be inserted in housing 216 in one operation. In embodiments in which pairs of signal conductors are inserted into housing 216 simultaneously, it is desirable for the pairs of signal conductors to be spaced on leadframe 300 with the same spacing required for insertion into housing 216. Similarly, in embodiments in which multiple pairs are inserted into housing 216 simultaneously, it is desirable for the pairs to have the spacing on leadframe 300 that is required for insertion into housing 216.

As illustrated in FIG. 3, the pairs of signal conductors 202 are held in lead frame 300 with the same spacing they will have when inserted into housing 216. Adjacent pairs of signal conductors, such as pairs 310G and 310F, have an on-center spacing of $D_1$. In some embodiments, $D_1$ may be less than 6 millimeters, and in one example is approximately 5.6 millimeters, and in another embodiment is approximately about 5 millimeters.

FIG. 3 also illustrates the on-center spacing $D_2$ of signal conductors 320A and 320B within a pair, such as pair 310E. In some embodiments, $D_2$ may be less than 2 millimeters, and in one example is about 1.85 millimeters, and in another example is about 1.25 millimeters.

It is not necessary that the on-center spacing of the mating portion 214 of each signal conductor within a pair be the same as the on-center spacing for the contact tails 212 of the pair of signal conductors. As illustrated in FIG. 3, the on-center spacing $D_2$ between the mating portions 214 of pair 310E is larger than the on-center spacing $D_3$ of the contact tails 212. The on-center spacing $D_3$ of contact tails 212 may be less than 1.85 millimeters. In some embodiments, the on-center spacing $D_3$ of contact tails 212 is approximately 1.4 millimeters.

Figure 4A:
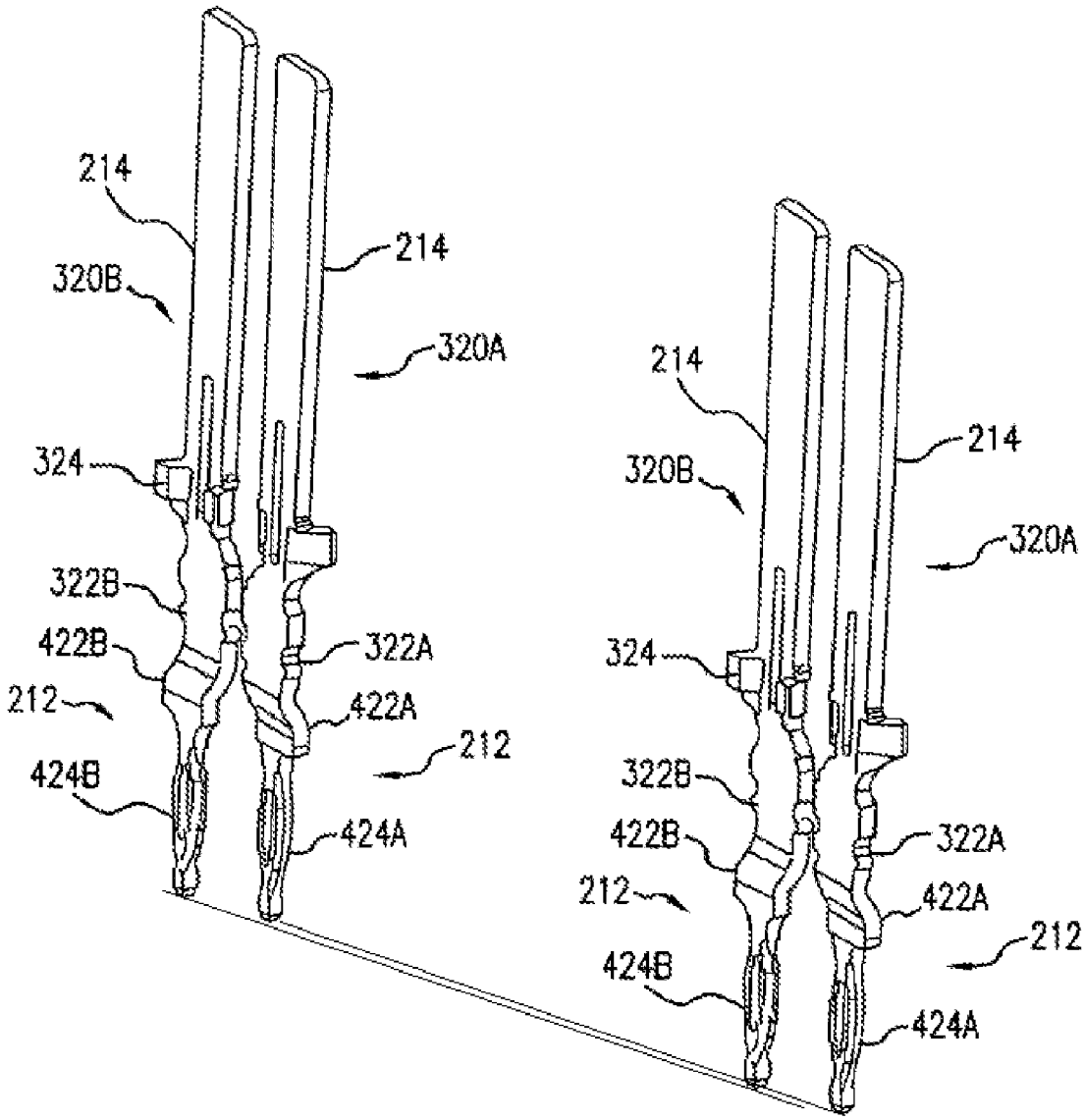
FIG. 4A is a perspective view of a pair of signal conductors of the leadframe of FIG. 3.

Turning to FIG. 4A, a pair of signal conductors 320A and 320B is shown in an enlarged view separated from leadframe 300. Signal conductors 320A and 320B are here shown to be generally in the form of blade-type signal conductors. However, signal conductors 320A and 320B include curved portions 422A and 422B, respectively. Curved portions 422A and 422B provide contact tails 212 with a desired spacing and orientation that may be different than the spacing and orientation of mating portions 214.

Figure 4B:
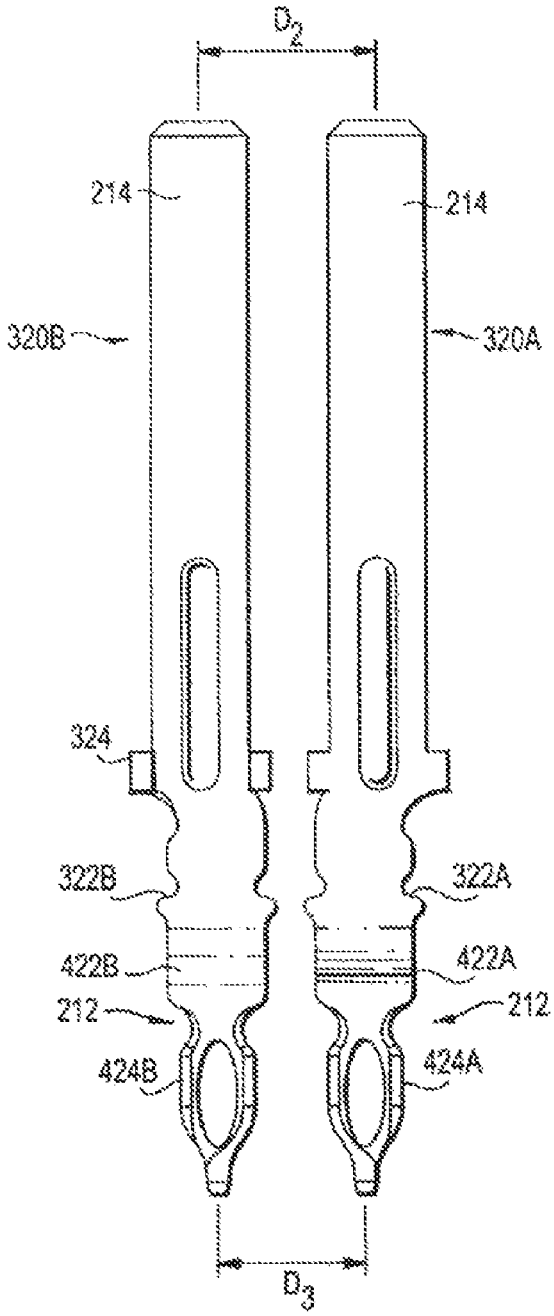
FIGS. 4B and 4C are schematic representations of the pair of signal conductors shown in FIG. 4A.

The position of contact tails 212 can be seen in FIG. 4B, which represents in schematic form a frontal view of the pair of signal conductors 320A and 320B. As can be seen from the frontal view in FIG. 4B, curved portions 422A and 422B provide an attachment point for compliant sections 424A and 424B of signal conductors 320A and 320B, respectively. Compliant sections 424A and 424B are mounted off-center relative to signal conductors 320A and 320B. In particular, compliant sections 424A and 424B are mounted such that the on-center spacing $D_3$ between central axes of compliant sections 424A and 424B of the contact tails is smaller than the on-center spacing $D_2$ between the central axes of mating portions 214 of signal conductors 320A and 320B.

As is described in greater detail below, the illustrated spacing reduces noise generated in the signal launch portion of the backplane.

The signal launch portion of the interconnection system provides a transition between traces in a printed circuit board, such as a backplane, and signal conductors within a connector. Within the printed circuit board, traces have a generally well controlled spacing from a ground plane. The ground plane provides shielding and impedance control such that the signal traces within a printed circuit board provide a relatively noise-less section of the interconnection system. Within the connector body, a similar impedance control structure may be provided by shielding members. However, such an impedance controlled section is lacking in the signal launch. Further, there is less shielding between pairs of signal conductors in the signal launch than in other portions of the interconnection system.

Making compliant sections 424A and 424B of the signal conductor pairs closer together than the mating portions allows the conductors and their associated plated holes in the printed circuit board of the interconnection system to be made closer together. Having the conductors and plated holes closer together increases the coupling between the conductors and creates a corresponding decrease in coupling between pairs of conductors that carry different differential signals. Therefore, by reducing the spacing between compliant sections 424A and 424B, crosstalk is reduced.

Figure 4C:
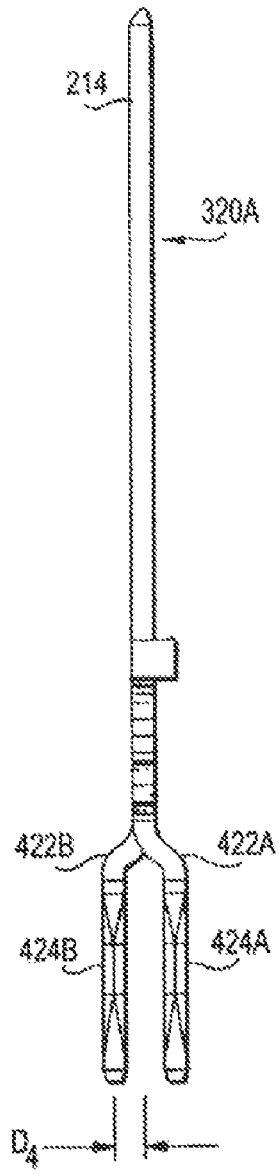

FIG. 4C illustrates an additional aspect of signal conductors 320A and 320B that further reduces crosstalk. FIG. 4C shows a side view of the pair of signal conductors 320A and 320B. FIG. 4C shows that curved portions 422A and 422B diverge, that is they bend in opposite directions relative to mating portions 214 of the pair of signal conductors. As a result, the relative axes are offset from one another such that compliant sections 424A and 424B are each offset a distance $D_4$ from the center of mating portion 214. The distance $D_4$ may be relatively small, such as less than 0.5 millimeters. In one embodiment, the distance $D_4$ may approximately 0.2 millimeters. Each compliant section may be offset from the nominal center of the signal conductors, though symmetrical offsets are not required and it is not necessary that both compliant sections be offset.

Figure 5B:
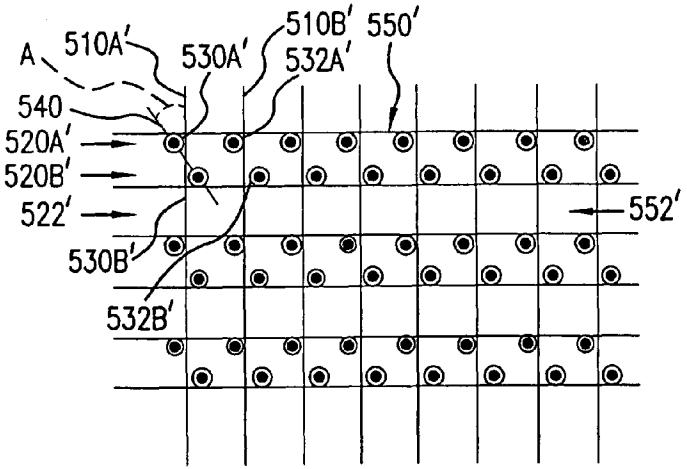
FIGS. 5B and 5C are diagrams illustrating placement of signal conductors in interconnection systems according to embodiments of the invention.
Figure 5A:
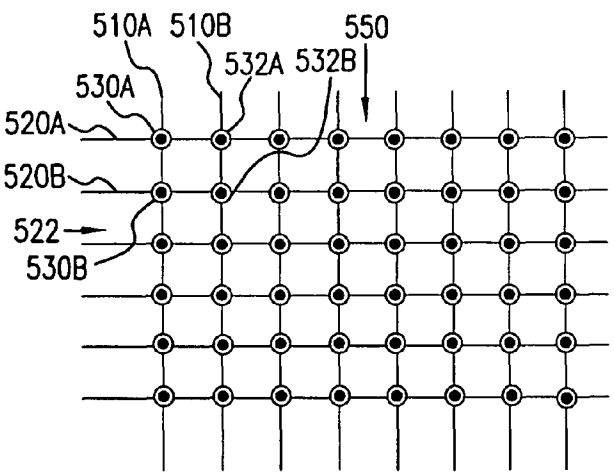
FIG.5A (PRIOR ART)
FIG. 5A is a diagram illustrating positions of signal conductors in a prior art interconnection system.
Figure 5C:
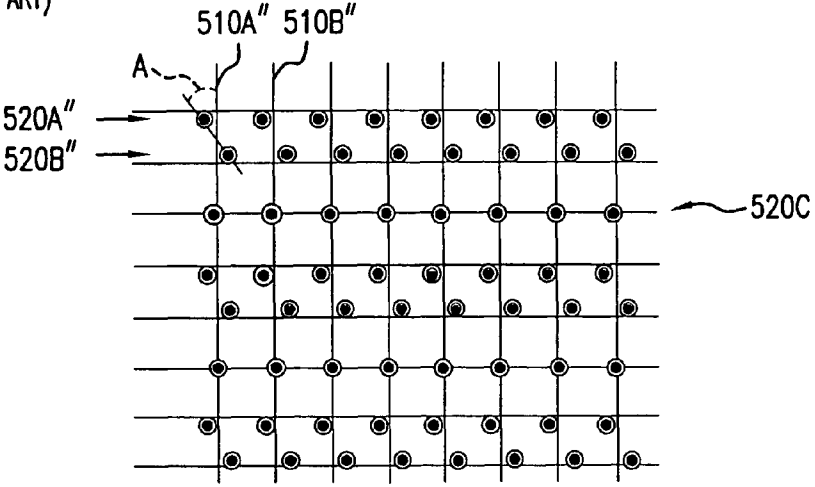

The net effect of the compound curve provided by curved portion 422 is illustrated by FIGS. 5A, 5B and 5C. FIG. 5A shows a prior art interconnection system and signal conductors of the interconnection system as they intersect in a plane. In the example of FIG. 5A, that plane is taken through the signal launch portion of the printed circuit board to which backplane connector 210 is mounted. Thus, the signal conductors illustrated in FIG. 5A are represented by plated holes of a printed circuit board associated with the conductors, of which conductors 530A, 530B, 532A and 532B are numbered. A view as depicted in FIG. 5A is sometimes referred to as the connector "footprint" on a printed circuit board. In FIG.

5A, the conductors are positioned in a rectangular array with columns, such as 510A, and 510B and rows 520A and 520B.

In contrast, FIG. 5B shows two changes that result from having curved portions 422A and 422B associated with each pair of signal conductors 202. Each pair of the conductors carrying a differential signal is positioned along one dimension of the array of conductors about a nominal column position, such as 510A' or 510B'. However, because of curved portions 422A and 422B, the pair of conductors, such as 530A' and 530B', is positioned along an axis 540 that is mechanically skewed relative to a nominal column position 510A' by an angle A. Further, because the compliant portions 424A and 424B are offset toward each other, the plated holes associated with each conductor pair, such as conductors 530A and 530B, fall in rows, such as 520A' and 520B' that are closer together than rows such as 520A and 520B (FIG. 5A).

Having the rows closer together increases coupling between the conductors that form a differential pair, which decreases coupling to adjacent signal conductors. The benefit of a mechanical skew of the axis on which each pair is disposed is illustrated in connection with FIG. 6A and FIG. 6B.

Figure 6A:
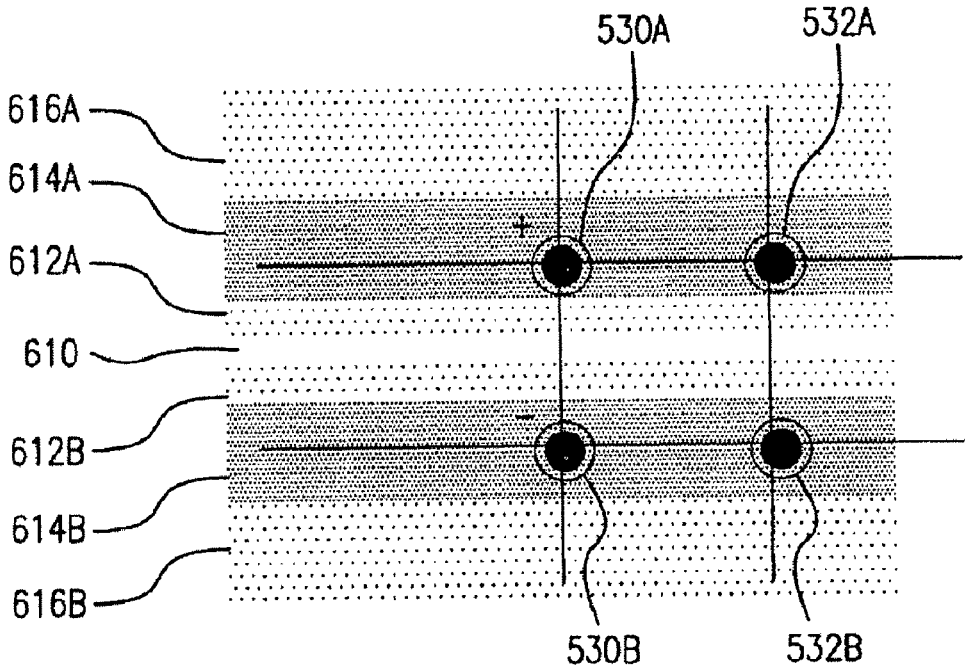
FIG.6A (PRIOR ART)
FIG. 6A is a diagram illustrating electrical interference between pairs of signal conductors in a prior art interconnection system.

FIG. 6A shows a portion of the footprint of FIG. 5A. In FIG. 6A, a pair of conductors 530A and 530B and a pair of conductors 532A and 532B in an adjacent column are shown. Each pair of holes may carry a differential signal via conductors through the signal launch portion of a printed circuit board. FIG. 6A illustrates the electromagnetic field strength associated with a signal propagated through pair of conductors 530A and 530B. In FIG. 6A, via 530A is indicated to have a "+" polarity and via 530B is illustrated carrying a signal of a "−" polarity. Such designations are used for identifying conductors carrying signals forming portions of a differential signal rather than indicating a polarity relative to any fixed reference level.

For a balanced differential pair, the electromagnetic potential at the center point between the conductors of the pair is zero because each conductor in a differential pair carries a signal of equal magnitude but opposite polarity such that the electromagnetic potential from each is equal in magnitude but of opposite polarity at the midpoint between the conductors of the pair. Accordingly, region 610 has zero electromagnetic field at the midpoint between the pair of conductors 530A and 530B. Closer to either of the conductors, the electromagnetic potential from the farther conductor does not fully cancel the electromagnetic potential from the nearer conductor. As a result, regions of increased electromagnetic potential occur between the conductors away from the center. Such regions of slightly increased electromagnetic potential are illustrated by regions 612A and 612B. Regions 612A and 612B contain electromagnetic potential generally of the same magnitude. However, regions 612A, being closer to conductor 530A, will have "+" polarity. Conversely, region 612B will have a "−" polarity. Regions 614A and 614B similarly have electromagnetic potential of opposite polarity, with regions 614A having a "+" polarity and region 614B containing electromagnetic potential of a "−" polarity. The magnitude of the electromagnetic potential in regions 614A and 614B is greater than the magnitude within regions 612A and 612B because regions 614A and 614B are even closer to one of the conductors than regions 612A and 612B.

In regions further from the signal conductors, the electromagnetic potential will still have a polarity influenced by the polarity of the signal carried by the closer of the two signal conductors, but the magnitude will be decreased because of the greater distance from the signal conductors. Accordingly, regions 616A and 616B are regions of "+" and "−" polarity, but smaller magnitude than two regions 614A and 614B.

While not being bound by any specific theory of operation, the present invention recognizes that FIG. 6A illustrates a drawback of a conventional electrical connector design. Specifically, the signal conductors, represented by their associated plated holes 532A and 532B, carrying a second differential signal fall within regions 614A and 614B, representing the largest electromagnetic potential generated by an adjacent pair of conductors, such as conductors 530A and 530B. Furthermore, the polarity of the signals in regions 614A and 614B are opposite. While differential signals are relatively insensitive to electromagnetic potential when both signal conductors in the pair are exposed to the same magnitude and polarity of radiation, differential signals become "noisy" when the conductors of the pair carrying the differential signal are exposed to electromagnetic radiation of different magnitudes or polarities. Accordingly, FIG. 6A represents a relatively poor position of adjacent pairs where noise immunity, and there reduced crosstalk, is desired.

Figure 6B:
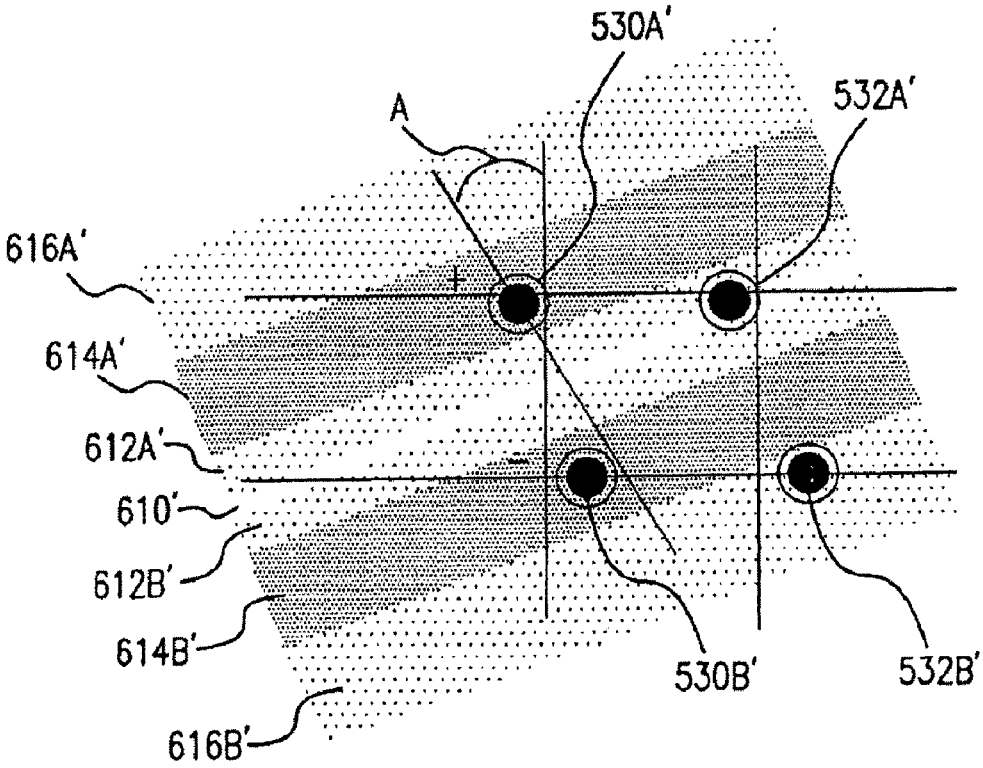
FIG. 6B is a diagram illustrating interference between pairs of signal conductors according to an embodiment of the invention.

FIG. 6B illustrates the field pattern of plated holes associated with a differential pair of conductors 530A' and 530B', such as might occur in the footprint for a connector with signal conductors as shown in FIG. 4A. The overall strength of the radiation associated with the pair 530A' and 530B' may be reduced because the signals are closer together. Additionally, the skew angle A alters the pattern of electromagnetic potential associated with pair of conductors 530A' and 530B' such that it has a lessened effect on an adjacent pair of conductors, such as 532A' and 532B'. As can be seen, the bands of electromagnetic potential, such as 610', 612A', 612B', 614A', 614B', 616A' and 616B', are skewed relative to the adjacent pair of conductors 530A' and 530B' by the angle A. For example, axis 540 (FIG. 5B) defined by conductors 530A' and 530B' is skewed by angle A with respect to the axis of the aligned column 510A'. This skewing places the adjacent conductors in bands of electromagnetic potential that have a significantly decreased impact than in the configuration illustrated in FIG. 6A.

This reduced impact may arise in two ways. First, the signal conductors in the adjacent pairs such, as 532A' and 532B', do not fall in bands 614A' and 614W, representing the largest electromagnetic potential from pair of conductors 530A' and 530W. Further, the skewing tends to bring the signal conductors in the adjacent pairs into bands of the same polarity. Because the differential signals carried through conductors 532A' and 532B' are relatively insensitive to common mode noise, exposing both conductors 532A' and 532B' to electromagnetic potential of the same polarity increases the common mode component and decreases the differential mode component of the radiation to which the differential pair is exposed. Therefore, the overall noise induced in the differential signal carried through conductors 532A' and 532B' is reduced relative to the level of noise introduced into the signals carried by conductors 532A and 532B as illustrated in FIG. 6A.

The magnitude of the angle A that produces a desired level of reduction in crosstalk may depend on factors, such as the distance between signal conductors within a pair of signal conductors carrying a differential signal and the spacing between pairs of signal conductors. An appropriate magnitude for the angle A may be determined empirically, by simulation or in any other convenient way. In some embodiments, the angle A may be about 20° or less. Such an angle may, for example, be suitable for embodiments in which conductors 530A' and 530B' have a diameter of 18 mils (0.46 millimeter) and are spaced apart along axis 540 by approximately 1.4 millimeters and the spacing between columns such as 510A' and 510B' is about 2 millimeters.

A decrease in crosstalk may be achieved by increasing the angle A. In some embodiments, the angle A may be greater than 200. However, as the angle A increases, the distance between conductors 530B' and 532A', as measured in the direction of rows, such as 520A' and 520B', decreases. Accordingly, the width of routing channels, such as routing channel 550' (FIG. 5B), between adjacent columns of signal conductors decreases. As the width of the unobstructed space between adjacent columns of conductors decreases, either fewer of traces may be routed in routing channel 550' or the traces must be routed with a serpentine pattern to stay clear of the conductors. Serpentine patterns for traces may be undesirable because they have worse signal transmission properties than straight traces and because fewer traces may be routed through a serpentine channel than through an unobstructed routing channel, such as routing channel 550 in FIG. 5A.

Any loss in ability to route signals through routing channel 550' may be partially offset by an increase in the width of routing channels running in the orthogonal, direction such as routing channels 552'. Nonetheless, it may sometimes be desirable for the angle A to be kept as small as needed to achieve the desired level of crosstalk reduction.

Crosstalk reduction achieved by mechanically skewing each of the pairs of signal conductors within a column may be employed to reduce crosstalk between any adjacent pair of signal conductors. For example, though FIG. 6B shows coupling from a differential signal traveling through pair of conductors 530A' and 530B' to a signal traveling in conductors 532A' and 532B', the mechanically skewed arrangement of the conductors as shown in FIG. 6B similarly reduces the coupling from conductors 532A' and 532B' to the signal carried through conductors 530A' and 530B' or between every other adjacent pairs in the footprint.

A mechanically skewed arrangement of differential signal conductors may be employed in other footprints or in other portions of the interconnection system. For example, FIG. 5C shows an alternative footprint for a connector. In the footprint of FIG. 5C, pairs of conductors are positioned along columns, such as columns 510A" and 510B". The individual conductor pairs are positioned in two adjacent rows. For example, conductors are positioned in rows 520A" and 520B". As shown, the conductors within each pair are mechanically skewed by an angle A relative to the nominal column orientation. The footprint of FIG. 5C differs from the footprint in FIG. 5B by the inclusion of a row 520C of conductors. The conductors in row 520C may be connected to ground, thereby providing shielding between adjacent pairs of signal conductors along each column through the signal launch portion of the interconnection system. Additionally, the conductors within row 520C may provide connections to shield members within the connector attached at the footprint.

Figure 7B:
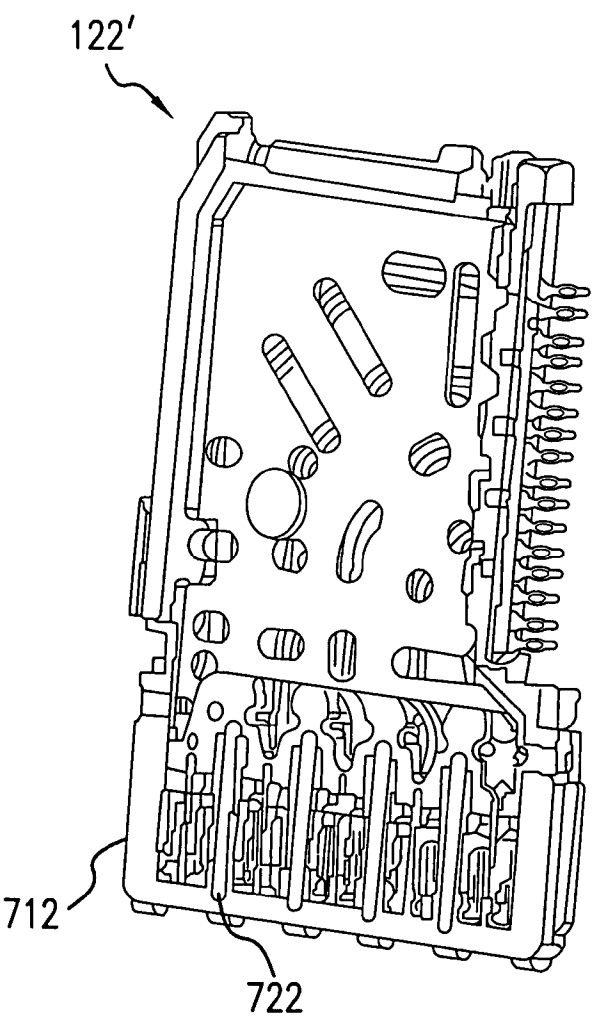
FIG. 7B is a front view of the electrical connector of FIG. 7A.
Figure 7A:
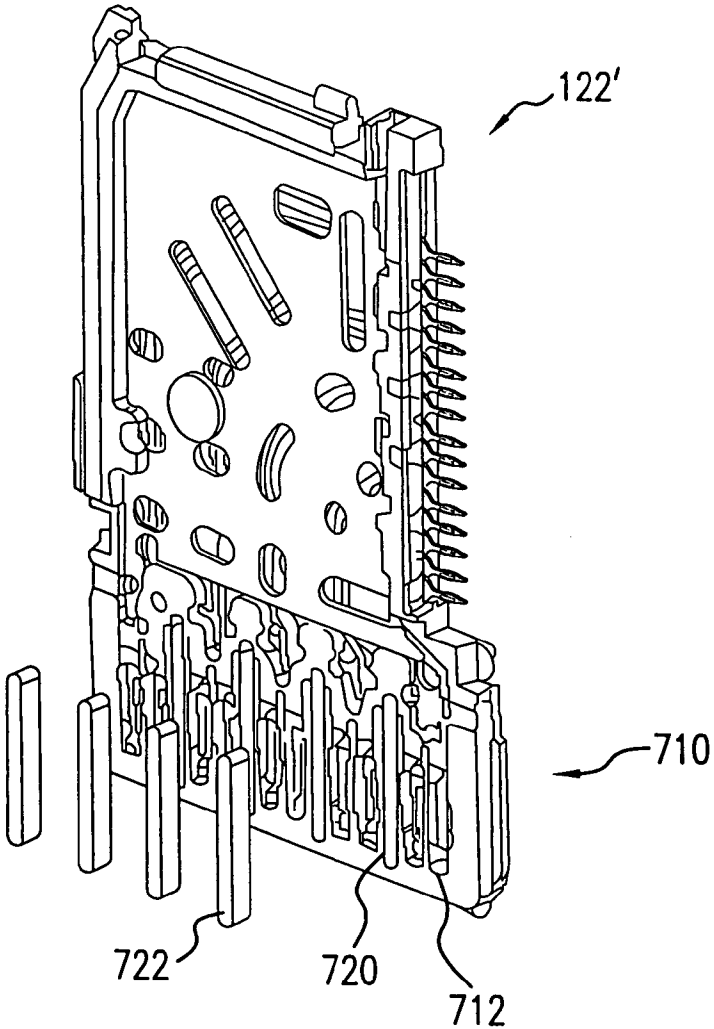
FIG. 7A is a partially exploded perspective view of an alternative embodiment of an electrical connector.

FIG. 5C demonstrates that mechanically skewing of pairs of signal conductors to reduce crosstalk may be used in conjunction with other techniques for crosstalk reduction. FIGS. 7A and 7B illustrate a further method by which crosstalk may be reduced. FIG. 7A shows a wafer 122' including features for further crosstalk reduction in an interconnection system. A section 710 of water 122' may be shaped to fit within housing 216 of backplane connector 210 and may include mating portions 712 of the signal conductors within wafer 122' that engage mating portions 214 of the signal conductors within backplane connector 210. In the embodiment illustrated, the mating portions 712 are positioned in pairs to align with mating portions 214 of backplane connector 210.

Wafer 122' may be formed with cavities 720 between the signal conductors within section 710. Cavities 720 are shaped to receive lossy inserts 722. Lossy inserts 722 may be made from or contain materials generally referred to as lossy conductors or lossy dielectric. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest.

Electrically lossy materials typically have a conductivity of 1 Siemens/meter to $6.1\times10^7$ Siemens/meter. Preferably, materials with a conductivity of 1 Siemens/meter to $1\times10^7$ Siemens/meter are used, and in some embodiments materials with a conductivity of about 1 Siemens/meter to $3\times10^4$ Siemens/meter are used.

Electrically lossy materials may be partially conductive materials, such as those that have a surface resistivity between 1 Ω/square and $10^6$Ω/square. In some embodiments, the electrically lossy material has a surface resistivity between 1 Ω/square and $10^3$Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding a filler that contains conductive particles to a binder. Examples of conductive particles that may be used as a filler to form an electrically lossy material include carbon or graphite formed as fibers, flakes, nickel-graphite powder or other particles. Metal in the form of powder, flakes, fibers, stainless steel fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers. Nanotube materials may also be used. Blends of materials might also be used.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material. In another embodiment, the binder is loaded with conducting filler between 10% and 80% by volume. More preferably, the loading is in excess of 30% by volume. Most preferably, the conductive filler is loaded at between 40% and 60% by volume.

When fibrous filler is used, the fibers preferably have a length between 0.5 mm and 15 mm. More preferably, the length is between 3 mm and 11 mm. In one contemplated embodiment, the fiber length is between 3 mm and 8 mm.

In one contemplated embodiment, the fibrous filler has a high aspect ratio (ratio of length to width). In that embodiment, the fiber preferably has an aspect ratio in excess of 10 and more preferably in excess of 100. In another embodiment, a plastic resin is used as a binder to hold nickel-plated graphite flakes. As a specific example, the lossy conductive material may be 30% nickel coated graphite fibers, 40% LCP (liquid crystal polymer) and 30% PPS (Polyphenylene sulfide).

Filled materials can be purchased commercially, such as materials sold under the trade name CELESTRAN® by Ticona. Commercially available preforms, such as lossy conductive carbon filled adhesive preforms sold by Techfilm of Billerica, Mass., US may also be used.

Lossy inserts 722 may be formed in any suitable way. For example, the filled binder may be extruded in a bar having a cross-section that is the same of the cross section desired for lossy inserts 722. Such a bar may be cut into segments having a thickness as desired for lossy inserts 722. Such segments may then be inserted into cavities 720. The inserts may be retained in cavities 722 by an interference fit or through the use of adhesive or other securing means. As an alternative embodiment, uncured materials filled as described above may be inserted into cavities 720 and cured in place.

FIG. 7B illustrates wafer 122' with conductive inserts 722 in place. As can be seen in this view, conductive inserts 722 separate the mating portions 712 of pairs of signal conductors. Wafer 122' may include a shield member generally parallel to the signal conductors within wafer 122'. Where a shield member is present, lossy inserts 722 may be electrically coupled to the shield member and form a direct electrical connection. Coupling may be achieved using a conductive epoxy or other conducting adhesive to secure the lossy insert to the shield member. Alternatively, electrical coupling between lossy inserts 722 and a shield member may be made by pressing lossy inserts 722 against the shield member. Close physical proximity of lossy inserts 722 to a shield member may achieve capacitive coupling between the shield member and the lossy inserts. Alternatively, if lossy inserts 722 are retained within wafer 122' with sufficient pressure against a shield member, a direct connection may be formed.

However, electrical coupling between lossy inserts 722 and a shield member is not required. Lossy inserts 722 may be used in connectors without a shield member to reduce crosstalk in mating portions 710 of the interconnection system.

While particular embodiments have been chosen to illustrate the invention, it will be understood by those skilled in the art that various changes and modifications can be made therein without departing from the scope of the invention as defined in the appended claims.

For example, the invention is not limited to a backplane/daughter card connector system as illustrated. The invention may be incorporated into connectors, such as mid-plane connectors, stacking connectors, mezzanine connectors or in any other interconnection system connectors.

Although an approach of reducing crosstalk by mechanically skewing pairs of signal conductors is illustrated with conductor holes in the signal launch portion of a backplane, signal conductors may be mechanically skewed in any portion of the interconnection system. For example, conductors may be skewed in the signal launch portion of a daughter card. Alternatively, signal conductors within either connector piece may be skewed.

As a further example, signal conductors are described to be arranged in rows and columns. Unless otherwise clearly indicated, the terms "row" or "column" do not denote a specific orientation. Also, certain conductors are defined as "signal conductors." While such conductors are suitable for carrying high speed electrical signals, not all signal conductors need be employed in that fashion. For example, some signal conductors may be connected to ground or may simply be unused when the connector is installed in an electronic system.

Although the columns are all shown to have the same number of signal conductors, the invention is not limited to use in interconnection systems with rectangular arrays of conductors. Nor is it necessary that every position within a column be occupied with a signal conductor. Likewise, some conductors are described as ground or reference conductors. Such connectors are suitable for making connections to ground, but need not be used in that fashion. Also, the term "ground" is used herein to signify a reference potential. For example, a ground could be a positive or negative supply and need not be limited to earth ground. Also, signal conductors are pictured to have mating contact portions shaped as blades and dual beams. Alternative shapes may be used. For example, pins and single beams may be used. Such alterations, modifications, and improvements are intended to be part of this disclosure, and are intended to be within the spirit and scope of the invention. Accordingly, the foregoing description and drawings are by way of example only.

What is claimed is:

1. An electrical connector comprising:

a first differential pair of signal conductors adapted to mate with a printed circuit board, said first differential pair of signal conductors including a first conductor and a second conductor;

said first conductor including a first mating portion at one end and a first contact portion at an opposite end, the first contact portion adapted to mate with the printed circuit board, said first conductor includes a first curved portion between said first mating portion and said first contact portion, wherein the first curved portion is curved in a first transverse direction; and a second transverse direction orthogonal to the first transverse direction;

said second conductor including a second mating portion, a second contact portion, the second contact portion adapted to mate with the printed circuit board, said second conductor includes a second curved portion between said second mating portion and said second contact portion, wherein the second curved part is curved in a third transverse direction and a fourth transverse direction orthogonal to the third transverse direction;

wherein the first transverse direction and the third transverse direction diverge and the second transverse direction and the fourth transverse direction converge.

2. The electrical connector according to claim 1, wherein the first mating portion of the first pair of signal conductors align along a first contact line, the first contact portion of the first pair of signal conductors align along a second contact line, the second contact portion of the first pair of signal conductors align along a third contact line and, the first contact line is parallel to both the second contact line and the third contact line.

3. An electrical connector, comprising:

at least one pair of signal conductors adapted to mate with a printed circuit board, said pair of signal conductors including first and second conductors, said first conductor including a first mating portion, a first contact portion, the first contact portion adapted to mate with the printed circuit board, said first conductor includes a first curved portion between said first mating portion and said first contact portion curved in a first transverse direction and a second curved portion curved in a second transverse direction orthogonal to the first transverse direction, said second conductor including a second mating portion, a second contact portion, the second contact portion adapted to mate with the printed circuit board, said second conductor includes a second curved portion between said second mating portion and said second contact portion curved in a third transverse direction and second curved portion curved in a fourth transverse direction;

wherein the first transverse direction and the third transverse direction diverge and the second transverse direction and the fourth transverse direction converge, and wherein the first conductor and the second conductor are disposed such that a plurality of bands of electromagnetic potential are skewed relative to the first line and the second line.

4. An electrical connector according to claim 3, further comprising a plurality of pairs of signal conductors, each of said pairs including first and second conductors, and each of said first and second conductors including a mating portion, a contact portion remote from said mating portion, and an intermediate portion therebetween.

5. An electrical connector according to claim 4, wherein a distance between adjacent signal conductor pairs is larger than an on-center spacing between first and second signal conductors of said adjacent signal conductors pairs.

6. The electrical connector according to claim 3, further comprising a dielectric housing, wherein the mating portions extend inside the dielectric housing and the contact portions extend outside the dielectric housing.

7. The electrical connector according to claim 3, wherein said mating portions comprise blades.

8. The electrical connector of claim 3, wherein each of said first and second mating portions includes a central longitudinal axis, each of said first and second contact portions defining a central longitudinal axis, and said central longitudinal axes of said first and second mating portions defining a first distance therebetween that is different than a second distance defined between said central longitudinal axes of said first and second contact portions and the first distance is larger than the second distance.

9. The electrical connector according to claim 3, wherein each of said first and second mating portions includes a central longitudinal axis, each of said first and second contact portions defining a central longitudinal axis, and said central longitudinal axes of said first and second mating portions defining a first distance therebetween that is different than a second distance defined between said central longitudinal axes of said first and second contact portions.

10. An interconnection assembly, comprising:

a first electrical connector mountable to a first printed circuit board, the first electrical connector including a plurality of signal conductor pairs, each of said pairs of signal conductors including first and second conductors engageable with respective pairs of first and second plated holes in said first printed circuit board, said pairs of first and second plated holes being disposed in a plurality of transverse columns and rows, wherein each of said first and second conductors includes a mating portion for connection to a second electrical connector mounted to a second printed circuit board and each of said first and second conductors further includes a contact portion for engaging respective first and second plated holes of said first printed circuit board; and said second electrical connector mateable with said first electrical connector, said second electrical connector including a plurality of lossy inserts, wherein said first plated holes are aligned with one another to define a first line, and each of said second plated holes is offset from said first plated hole such that a second line is defined between one of said first plated holes and one of said second plated holes, the second line being angularly oriented with respect to the first line at an angle, and wherein the contact portion of the first conductor and the contact portion of the second conductor bend in opposite directions relative to said pairs of signal conductors such that the contact portion of the first conductor and the contact portion of the second conductor are offset from a center axis of the signal conductor pair, and wherein the contact portion of the first conductor and the contact portion of the second conductor curve towards each other parallel to the center axis of the signal conductor pair.

11. An interconnection assembly according to claim 10, wherein said angle is about 45 degrees or less.

12. An interconnection assembly according to claim 10, wherein a distance between adjacent signal conductor pairs is larger than an on-center spacing between first and second signal conductors of said adjacent signal conductor pairs.

13. An interconnection assembly according to claim 10, further comprising a dielectric housing, wherein the mating portions extend inside the dielectric housing and the contact portions extend outside the dielectric housing.

14. The interconnection assembly according to claim 10, wherein said mating portions comprise blades.

15. The interconnection assembly of claim 10, wherein each of said mating portions includes a central axis, each of said contact portions define a central axis, and said central axes of said mating portions define a first distance therebetween that is different than a second distance defined between said central axes of said contact portions and the first distance is larger than the second distance.

16. The interconnection assembly of claim 10, wherein each of said mating portions includes a central axis, each of said contact portions define a central axis, and said central axes of said mating portions define a first distance therebetween that is different than a second distance defined between said central axes of said contact portions.

17. The interconnection assembly according to claim 10, wherein said angle is about 20 degrees or less.

* * * * *